United States Patent [19]

Opresco et al.

[11] Patent Number: 4,513,970

[45] Date of Patent: Apr. 30, 1985

[54] POLYMORPHIC TWIST PUZZLE

[76] Inventors: Ovidiu Opresco, 3177 33 St., Long Island City, N.Y. 11106; Jon D. Marinesco, 90-02 63 Ave., Rego Park, N.Y. 11374

[21] Appl. No.: 465,562

[22] Filed: Jan. 24, 1983

[51] Int. Cl.[3] ..... A63F 9/08

[52] U.S. Cl. ..... 273/153 S

[58] Field of Search ..... 273/153 S

[56] References Cited

U.S. PATENT DOCUMENTS

| | | | |
|---|---|---|---|
| 3,075,304 | 1/1963 | Votolato | 273/157 X |
| 3,655,201 | 4/1972 | Nichols | 273/153 S X |
| 4,405,131 | 9/1983 | Horvath | 273/153 S |
| 4,415,158 | 11/1983 | Engel | 273/153 S |

FOREIGN PATENT DOCUMENTS

| | | | |
|---|---|---|---|
| 170062 | 12/1977 | Hungary | 273/153 S |
| WO83/01203 | 4/1983 | PCT Int'l Appl. | 273/153 S |

OTHER PUBLICATIONS

Evercheering Enterprise Co., Ltd., Advertising Brochure, one page.

*Primary Examiner*—Anton O. Oechsle
*Attorney, Agent, or Firm*—A. A. Saffitz

[57] ABSTRACT

A three dimensional puzzle or toy, of the type sold under the registered trademark RUBIK'S CUBE, in which eight outer bodies or blocks are rotated four at a time about any one of three axes, so that different shapes may be presented in different combinations of said outer bodies. The outer bodies present a desired shape, such as an egg, sphere, clown's head or other desired shape only when the outer bodies are in proper combination. The outer bodies revolve about a spherical core, and are releasably maintained assembled about said core by magnetic means on the adjoining surfaces of the outer bodies.

1 Claim, 10 Drawing Figures

POLYMORPHIC TWIST PUZZLE

FIELD OF INVENTION

The present invention relates generally to three dimensional puzzles and toys and particularly to those in which eight outer bodies or blocks are rotated four at a time about any one of three axes, so that different shapes may be presented in different combinations.

BACKGROUND OF INVENTION

Such puzzles or toys are sometimes known as rotary combination toys as shown in U.S. Pat. No. 4,344,623, in which a central portion is provided with guide canopies through which movable outer blocks slide from position to position.

In U.S. Pat. No. 3,655,201 eight cubes are magnetically engaged and are adapted to rotate in complementary sets of four about one of three mutually perpendicular axes.

Such prior art rotary combination toys and puzzles allow patterns or colors on three faces of each block or cube to be successively combined until a desired combination of numbers or colors are presented, e.g., in the type sold under the registered trademark "Rubik's Cube," in which each of the six faces of the overall cube are of one of six selected colors.

However, the prior art does not teach a puzzle which varies in overall shape, yielding a desired shape only in the proper combination. Further, the prior art structures either have complex interior mechanisms and parts and are difficult to assemble, reassemble, and rotate, such as the planetary mechanisms, with guide canopies and tracks of U.S. Pat. No. 4,344,623 cited above, or are so loosely structured and connected that they are difficult to rotate and tend to fall apart when rotated, such as the bar magnet building blocks of U.S. Pat. No. 3,655,201 cited above.

OBJECTS OF THE INVENTION

The present invention is designed to overcome the limitations in the prior art described above.

A primary object is to teach a three dimensional rotary combination shape puzzle, in which the rotating outer bodies form varying shapes, producing a desired shape only when the outer bodies are in proper combination, such as an egg, a sphere, a clown's head, horse, automobile, apple, or any other desired shape.

Another object is to provide a shape puzzle in which the desired shape is formed by outer bodies rotating about a spherical core.

Another object is to provide a shape puzzle which challenges and tests abilities other than color perception, such as tactile and shape perception.

Another object is to provide a rotatable three dimensional puzzle which is easy to manufacture, assemble, operate and reassemble.

Another object is to provide a three dimensional rotary puzzle in which the parts can be moved easily and accurately about a spherical core without disassembly.

Other objects and features of the invention will become apparent upon reading the description of its preferred embodiments below.

SUMMARY OF THE INVENTION

In general, the present invention teaches a three dimensional shape puzzle in which a plurality of outer bodies, magnetically or mechanically engaged to each other, are rotatable about three mutually perpendicular axes in sets of four and said outer bodies present a desired shape when in the proper combination, and irregular or random shapes when in other combinations.

In a principal embodiment, eight outer bodies are magnetically engaged to each other and rotatable about a spherical core present a desired overall shape, such as an egg, a car, a horse, a clown's head, or an apple, which desired shape is achieved when the outer bodies are in proper combination.

In a second embodiment, the desired shape is symmetrical, such as a cube, but the axes of rotation selected are not the axes of symmetry, so that the desired shape is achieved only when the outer bodies are in proper combination.

In a third embodiment, the eight outer bodies form a desired shape which is symmetrical, such as a sphere or cube, but the inner spherical core is eccentrically located in the overall desired shape, so that the desired shape is achieved only when the outer bodies are in proper combination.

DESCRIPTION OF THE DRAWINGS

The preferred embodiments are illustrated in the following perspective view drawings.

DETAILED DESCRIPTION

Figure 1:
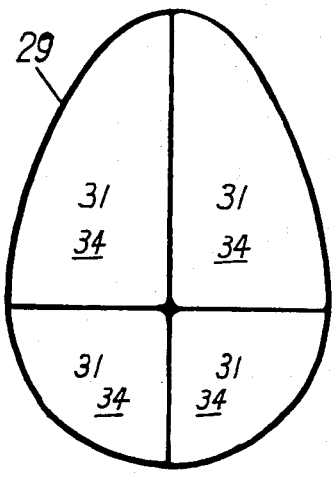
FIG. 1 is a view of a first preferred embodiment of the invention, in which the outer bodies form an ovoid or egg.
Figure 2:
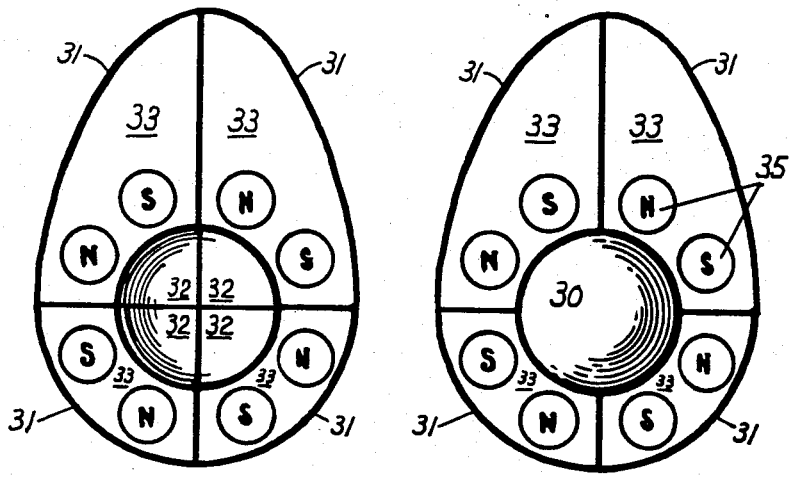
FIG. 2 is a view of the egg of FIG. 1 separated into two sets of outer bodies, showing the spherical core.
Figure 3:
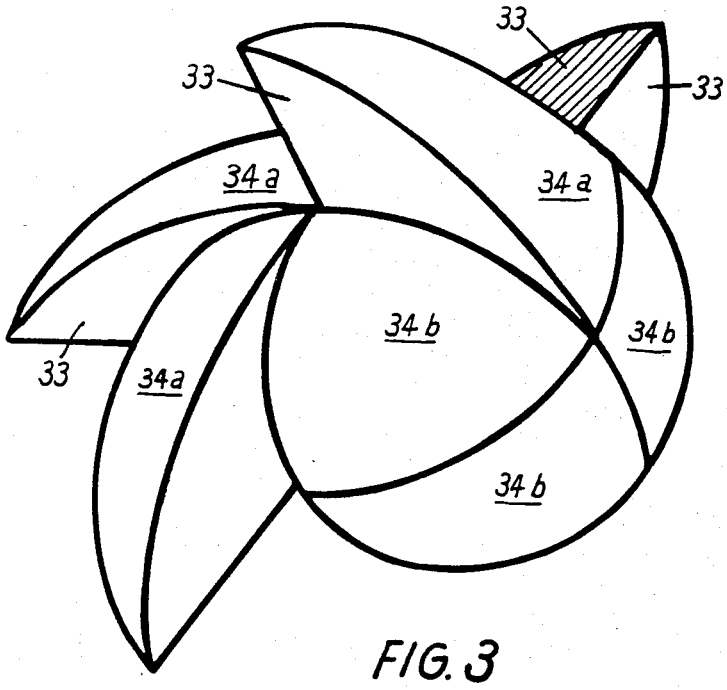
FIG. 3 is a view of the egg in FIG. 1 in which the outer bodies are not assembled in proper combination but are in random combination.

Referring now to the drawings, FIGS. 1–3 illustrate the first preferred embodiment, in which the invention is used to present an ovoid shape or egg in proper combination.

FIG. 1 shows the eight outer bodies 31 assembled in proper combination. FIG. 2 shows egg 29 divided into two sets of four outer bodies 31, and a spherical core 30. The core 30 is not affixed to any of the outer bodies 31, but may rotate freely with respect to them all. Each of the outer bodies has an inner surface 32, three flat adjoining surfaces 33 and an outer surface 34.

As seen in FIG. 2, the outer bodies 31 each have identical inner surfaces 32 which are spherically concave, and which conform to and are movable over the spherical core 30. Each outer body has three flat mutually perpendicular adjoining surfaces 33 defining planes of rotation which intersect at the center of spherical core 30. Each of the three adjoining surfaces 33 is provided with two pill magnets 35 with alternating north poles N and south poles S exposed. The pill magnets 35 are embedded in the adjoining surfaces 33 and flush thereto. The pill magnets 35 are spaced from each other and from the spherical core 30 to correspond with their counterparts of opposing polarities on each of the adjoining outer bodies 31. Outer bodies 31 rotate along the adjoining surfaces 33 which are mutually perpendicuar, and the axes of rotation pass through the center of spherical core 30.

In accordance with the invention, the outer surfaces 34 of the eight outer bodies 31 comprise the visible portions thereof, and form an egg 29 when in the proper combination of FIG. 1. Here the shape selected is an egg, and is symmetrical across two of the three planes defined by the adjoining surfaces 33, hence there are two sets of four identical outer bodies 31 and several combinations thereof will yield the desired egg shape shown in FIG. 1. The outer surfaces 34 of the eight outer bodies 31 thus fall in two sets of identical shapes, shown in FIG. 3 as 34*a* and 34*b*, forming the egg 29 in proper combination (FIG. 1).

In operation, the first embodiment is assembled by applying the inner surfaces 32 of the eight outer bodies 31 to the core 30 either in the desired shape to be restored (FIG. 1) or in random combination (FIG. 3).

The magnets 35 on the adjoining surfaces 33 of each of the outer bodies 31 are in registration with their counterparts on the adjoining surfaces 33 of the three adjoining outer bodies 31 and hold the assembly in cohesion.

Once the outer bodies 31 are in place on core 30, any set of four of the outer bodies 31 may be rotated 90° at a time with respect to the other four outer bodies, about any one of the three axes of rotation, as is known in the prior art.

Rotation may be effected by gripping a set of four of the outer bodies 31 in each hand and twisting each set of four along the adjoining surfaces 33 about one of the three axes of rotation. Pill magnets 35 release upon twisting and reengage with their new counterparts after 90° of rotation. Spherical core 30 greatly facilitates rotation by keeping the adjoining surfaces 33 and magnets 35 aligned during the 90° rotation, until the magnets 35 reengage with their new counterparts.

By selecting the sets of four outer bodies 31 to be rotated with respect to the spherical core 30, and with respect to each other, the player may change the relationship between outer surfaces 34 varying the overall shape of the assembly until the proper combination results in the desired egg shape of FIG. 1.

FIG. 3 shows the outer bodies 31, rotated in improper combination exposing portions of the adjoining sufaces 33. However, in the proper combination of FIG. 1, only the outer surfaces 34 and not the adjoining surfaces 33 are visible.

In accordance with invention, the outer bodies may form any other desired shape, symmetrical or asymmetrical, such as a clown's head, horse, apple, automobile, in proper combination. Also, the invention may be used as a toy, with a view to merely assembling the outer bodies about the core in the desired shape, without rotation, rather than as a shape puzzle.

Figure 4:
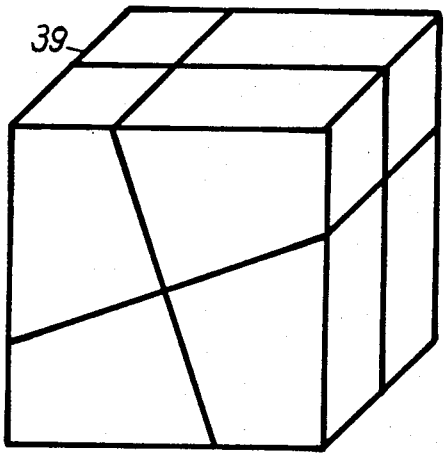
FIG. 4 is a view of a second embodiment in which the outer bodies properly combined form a symmetrical shape, a cube.

In a second embodiment of the invention, shown in FIGS. 4–8, even a symmetrical object such as a cube 39 may be formed by the outer surfaces 44*a–h* of the outer bodies 41 about a spherical core 40 (FIG. 4). The outer bodies 41 form a cube 39, when in proper combination, as in FIG. 4, and an irregular shape otherwise, as in FIG. 7.

Figure 6:
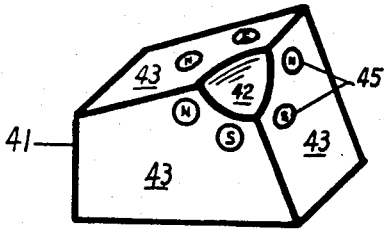
FIG. 6 is a view of one of the outer bodies of the cube in FIG. 4.

The outer bodies 41, one of which is shown in FIG. 6, are identical though irregular and have spherically concave inner surfaces 42 which conform and bear upon spherical core 40, and pill magnets 45 imbedded on the adjoining surfaces 43 in pairs with alternating polarities spaced from each other and from the spherical core 40 so as to register with their counterparts of opposing polarities on adjoining outer bodies 41.

Figure 5:
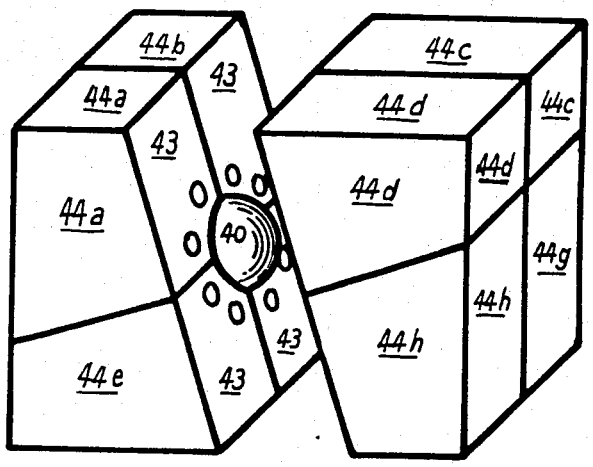
FIG. 5 is a view of the cube in FIG. 4 separated into two sets of outer bodies, showing the spherical core.

The adjoining surfaces 43 again lie in three planes mutually perpendicular to each other and intersecting at the center of the spherical core 40, as shown in FIG. 5.

Figure 7:
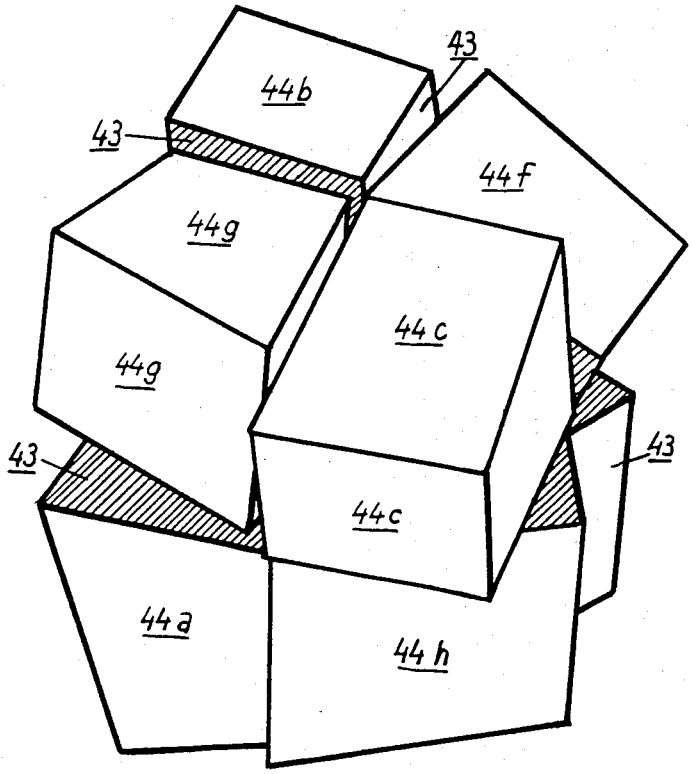
FIG. 7 is a view of the cube in FIG. 4 in which the outer bodies are not combined properly, resulting in an irregular outer shape.

However, two of the planes defined by the adjoining surfaces 43 of the outer bodies 41 are not parallel to the planes of the cube 39 formed by the outer surfaces 44*a–h*, resulting in irregular overall shapes and exposure of parts of the adjoining surfaces 43 (FIG. 11) when not in the proper combination shown in FIG. 6. Locating the spherical core 40 at the center of the cube results in identical outer bodies 41 as shown in FIG. 7 and in one of the planes of rotation being parallel to the faces of cube 39.

In operation, outer bodies 41 are rotated in groups of four in 90° intervals about the three axes until the proper combination shown in FIG. 4 is achieved.

Irregular shapes may also be achieved by eccentrically locating the spherical core in the desired cube, sphere or other symmetrical body resulting in eight unidentical outer bodies.

Figure 8:
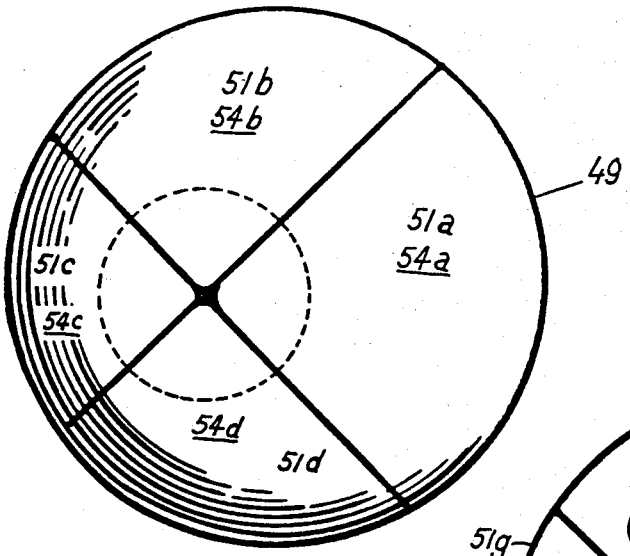
FIG. 8 is a view of a third embodiment in which the outer bodies form a sphere with the eccentrically located spherical core shown in dotted lines.
Figure 9:
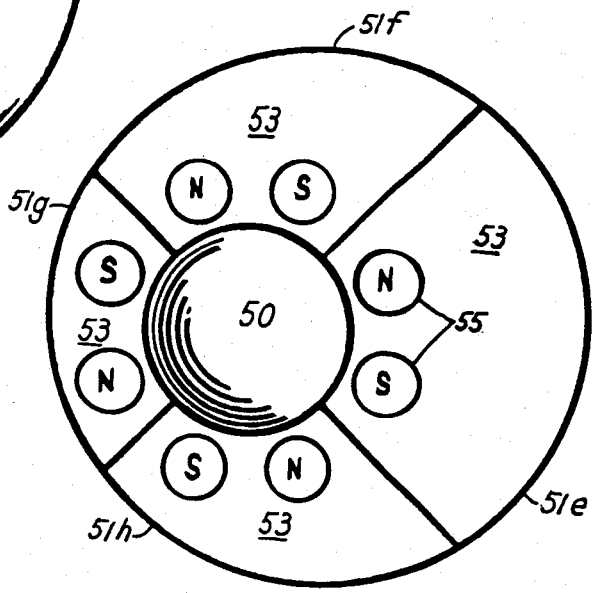
FIG. 9 is a view of the sphere of FIG. 8, in which four of the outer bodies have been removed and the core is shown.
Figure 10:
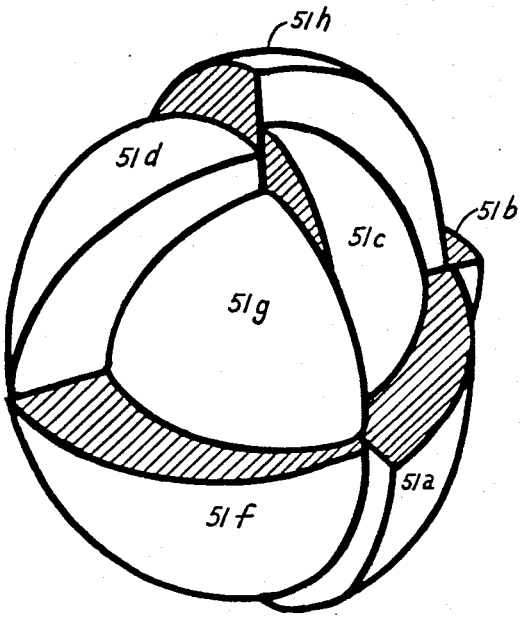
FIG. 10 is a view of the sphere of FIG. 8, in which the outer bodies are not combined properly but are in random combination.

This is illustrated in FIGS. 8–10, in which the outer surfaces 54*a–h* of eight unidentical outer bodies 51*a –h* form a sphere 49 in proper combination (FIG. 8), and an irregular shape (FIG. 10) otherwise. The free spherical core 50 is eccentrically located as shown in FIGS. 8–9, to produce eight unidentical outer bodies 51*a–h* and the planes defined by the adjoining edges 53 pass through the center of the core 50. Pill magnets 55 are disposed as in the first and second embodiments described above.

In operation, once assembled, groups of four outer bodies 51 are rotated in 90° intervals about the spherical core 50, as in the other embodiments, with a view to forming the desired overall shape of a sphere 49. However, the eccentric placement of core 50 results in irregular overall shapes as shown in FIG. 10, except in the proper combination of FIG. 8. Concentric placement of core 50 results in a sphere in all combinations, and such an embodiment could be used as a color puzzle to match colors or indicia on identical adjoining outer bodies 51, when proper combinations are effected.

Although sets of eight outer bodies have been described, additional sets and axes of rotation may be introduced increasing the number of combinations and complexity of shapes. For example, the desired shape may be an octahedron of thirty-two identical pieces rotatable about six axes.

Also in any of these embodiments, engagement of the outer bodies may be effected by the less efficient mechanical means known in the prior art rather than the magnets and spherical core taught herein to produce the varying shapes of the shape puzzle taught here. For example, a a puzzle of the type sold under the registered trademark Rubik's Cube could be shaved to form a desired shape to be restored upon rotating the outer bodies into random combination.

Also the present invention has been shown in its preferred and most practical embodiments, but it is recognized that departures may be made therefrom within the scope of the invention, which is not limited to the details disclosed herein, but is to be accorded the full scope of the claims, embracing equivalent devices and apparatus.

What is claimed is:

1. A three dimensional combination puzzle comprising a spherical core, eight outer bodies each having a spherical inner surface movable over said core, three adjoining surfaces and an outer surface, said adjoining surfaces mutually perpendicular to each other and defining planes of rotation intersecting at the center of said speherical core, means associated with said adjoining surfaces releasably maintaining said outer bodies assembled about said core, and enabling said outer bodies to be rotated in sets of four about said core, said outer surfaces forming a cube when said outer bodies are in proper combination and a plurality of said adjoining surfaces are not parallel to the faces of said cube.

* * * * *